US011192146B2

(12) United States Patent
Hawkins et al.

(10) Patent No.: US 11,192,146 B2
(45) Date of Patent: Dec. 7, 2021

(54) SYSTEM AND METHOD FOR SORTING SCRAP MATERIALS

(71) Applicant: HURON VALLEY STEEL CORPORATION, Trenton, MI (US)

(72) Inventors: Michael A Hawkins, Belleville, MI (US); Kalyani Chaganti, Canton, MI (US); Paul Torek, Ann Arbor, MI (US); Benjamin H Aubuchon, Rockwood, MI (US); Richard Wolanski, Dexter, MI (US); Kerry Lang, Taylor, MI (US)

(73) Assignee: Huron Valley Steel Corporation, Trenton, MI (US)

( * ) Notice: Subject to any disclaimer, the term of this patent is extended or adjusted under 35 U.S.C. 154(b) by 115 days.

(21) Appl. No.: 16/497,471

(22) PCT Filed: Mar. 27, 2018

(86) PCT No.: PCT/US2018/024582
§ 371 (c)(1),
(2) Date: Sep. 25, 2019

(87) PCT Pub. No.: WO2018/183337
PCT Pub. Date: Oct. 4, 2018

(65) Prior Publication Data

US 2020/0101497 A1 Apr. 2, 2020

Related U.S. Application Data

(60) Provisional application No. 62/477,589, filed on Mar. 28, 2017.

(51) Int. Cl.
*B07C 5/344* (2006.01)
*B07C 5/36* (2006.01)

(52) U.S. Cl.
CPC ..... *B07C 5/344* (2013.01); *B07C 5/368* (2013.01); *B07C 2501/0018* (2013.01)

(58) Field of Classification Search
CPC ..... B07C 5/34; B07C 5/342; B07C 5/344; B07C 5/36; B07C 5/368;
(Continued)

(56) References Cited

U.S. PATENT DOCUMENTS 4,563,644 A 1/1986 Lenander et al.
4,718,559 A 1/1988 Kenny et al.
(Continued)

FOREIGN PATENT DOCUMENTS

CN 106423913 A 2/2017
GN 1396845 A 2/2003
(Continued)

OTHER PUBLICATIONS

International Search Report and Written Opinion for Application No. PCT/US201 8/024582, dated Jul. 18, 2018, 17 pages.
(Continued)

*Primary Examiner* — Charles A Fox
*Assistant Examiner* — Molly K Devine
(74) *Attorney, Agent, or Firm* — Brooks Kushman P.C.

(57) ABSTRACT

A system has a conveyor for carrying at least two categories of scrap particles positioned at random on a surface of the conveyor, with at least some of the particles comprising metal. The system has a sensor array with a series of analog inductive proximity sensors arranged transversely across the conveyor. An active sensing end face of each sensor lies in a sensing plane, and the sensing plane is generally parallel with the surface of the conveyor. A control system of is configured to sample and quantize analog signals from the series of sensors in the array, and locate and classify a scrap particle on the conveyor passing over the array into one of
(Continued)

at least two categories of material based on the quantized signals. A method for sorting the particles is also provided.

20 Claims, 7 Drawing Sheets

(58) Field of Classification Search
CPC ..... B07C 2501/0018; G01J 3/28; G06K 9/46; C22B 1/00; G06T 7/20
USPC ..... 209/571, 556
See application file for complete search history.

(56) References Cited

U.S. PATENT DOCUMENTS

| | | | | |
|---|---|---|---|---|
| 5,413,222 | A | 5/1995 | Holder | |
| 6,144,004 | A * | 11/2000 | Doak | B07C 5/3425 209/581 |
| 6,757,584 | B2 * | 6/2004 | Thess | B07C 5/34 700/223 |
| 7,658,291 | B2 | 2/2010 | Valerio | |
| 7,674,994 | B1 | 3/2010 | Valerio | |
| 8,360,242 | B2 | 1/2013 | Valerio | |
| 9,119,239 | B2 | 8/2015 | Engel-Hall et al. | |
| 2003/0132142 | A1 | 7/2003 | Kumar | |
| 2007/0262000 | A1 | 11/2007 | Valerio | |
| 2009/0250384 | A1 | 10/2009 | Valerio | |
| 2013/0297251 | A1 | 11/2013 | Engel-Hall et al. | |
| 2014/0260801 | A1 | 9/2014 | Wellwood et al. | |
| 2016/0187199 | A1 | 6/2016 | Brunk et al. | |
| 2016/0189381 | A1 | 6/2016 | Rhoads | |

FOREIGN PATENT DOCUMENTS

| | | | |
|---|---|---|---|
| GN | 104540603 | A | 4/2015 |
| GN | 105013718 | A | 11/2015 |
| KR | 1020130096517 | A | 8/2013 |

OTHER PUBLICATIONS

International Preliminary Report on Patentability for Application No. PCT/US2018/024582, dated Oct. 10, 2019, 11 pages.
Chinese Office Action for Application No. 201880034949.X, dated Feb. 26, 2021, 9 pages.
European Search Report and Written Opinion for Application No. 18774274.7, dated Nov. 19, 2020, 6 pages.

* cited by examiner

SYSTEM AND METHOD FOR SORTING SCRAP MATERIALS

CROSS-REFERENCE TO RELATED APPLICATIONS

This application is the U.S. national phase of PCT Application No. PCT/US2018/024582 filed on Mar. 27, 2018, which claims the benefit of U.S. provisional application Ser. No. 62/477,589 filed Mar. 28, 2017, the disclosures of which are hereby incorporated in their entirety by reference herein.

TECHNICAL FIELD

Various embodiments relate to a system and method for sorting scrap materials, including scrap materials containing metal, in a line operation.

BACKGROUND

Scrap metals are currently sorted at high speed or high volume using a conveyor belt or other line operations using a variety of techniques including: hand sorting by a line operator, air sorting, vibratory sorting, magnetic sorting, spectroscopic sorting, and the like. The scrap materials are typically shredded before sorting and require sorting to facilitate separation and reuse of materials in the scrap, for example, by sorting based on classification or type of material. By sorting, the scrap materials may be reused instead of going to a landfill or incinerator. Additionally, use of sorted scrap material utilizes less energy and is more environmentally beneficial in comparison to refining virgin feedstock from ore or manufacturing plastic from oil. Sorted scrap materials may be used in place of virgin feedstock by manufacturers if the quality of the sorted material meets a specified standard. The scrap materials may be classified as metals, plastics, and the like, and may also be further classified into types of metals, types of plastics, etc. For example, it may be desirable to classify and sort the scrap material into types of ferrous and non-ferrous metals, heavy metals, high value metals such as copper, nickel or titanium, cast or wrought metals, and other various alloys.

SUMMARY

In an embodiment, a system is provided. The system has a conveyor for carrying at least two categories of scrap particles positioned at random on a surface of the conveyor, with at least some of the particles comprising metal. The conveyor travels in a first direction. The system has a sensor array with a series of analog inductive proximity sensors arranged transversely across the conveyor. An active sensing end face of each sensor lies in a sensing plane, and the sensing plane is generally parallel with the surface of the conveyor. A control system of is configured to sample and quantize analog signals from the series of sensors in the array, and locate and classify a scrap particle on the conveyor passing over the array into one of at least two categories of material based on the quantized signals.

In another embodiment, a method is provided. Scrap particles are sensed on a surface of a moving conveyor using a sensing array with a series of analog proximity sensors arranged such that active end faces of each of the sensors lie in a common sensing plane. The common sensing plane is generally parallel with the surface of the conveyor. An analog signal from each of the sensors in the array is sampled and quantized using a control system to provide a corresponding quantized value. A matrix is created that corresponds to a timed, physical location of the conveyor using the control system, and quantized values are input into cells in the matrix. A grouping of cells in the matrix is identified as a particle using the control system by distinguishing the particle from a background indicative of the conveyor. The particle is classified using the control system into one of at least two categories of material using a classification input calculated from the values in the grouping of cells in the matrix associated with the particle.

DETAILED DESCRIPTION

As required, detailed embodiments are disclosed herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

It is recognized that any circuit or other electrical device disclosed herein may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices as disclosed herein may be configured to execute a computer-program that is embodied in a non-transitory computer readable medium that is programmed to perform any number of the functions as disclosed herein.

Figure 1:
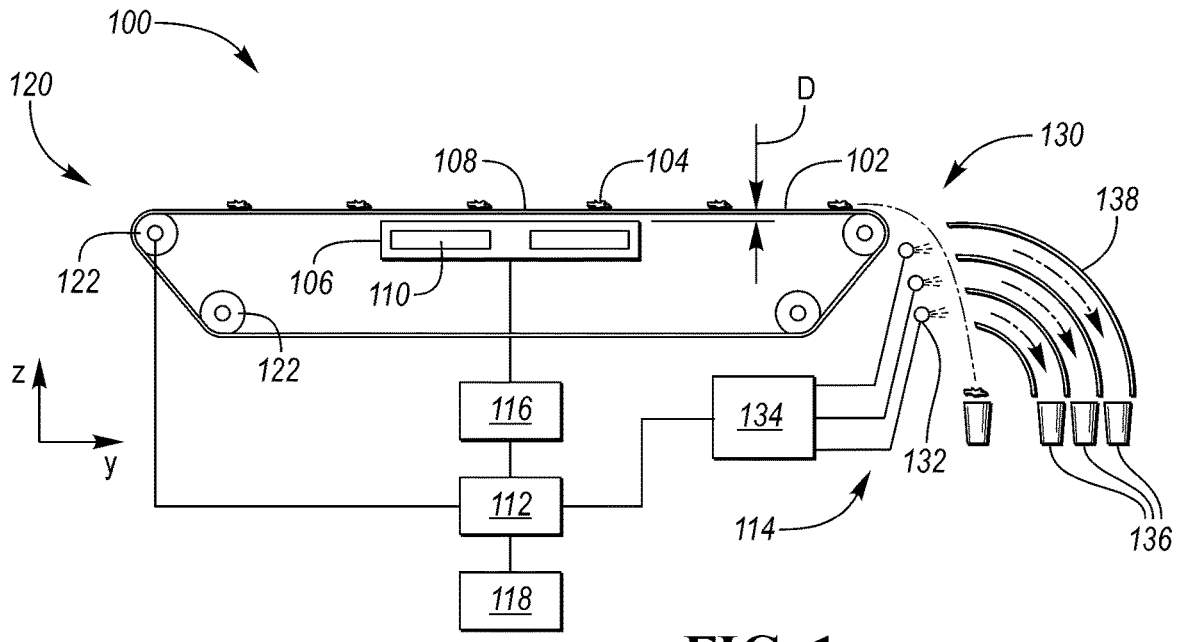
FIG. 1 illustrates a side schematic view of a sorting system according to an embodiment.
Figure 2:
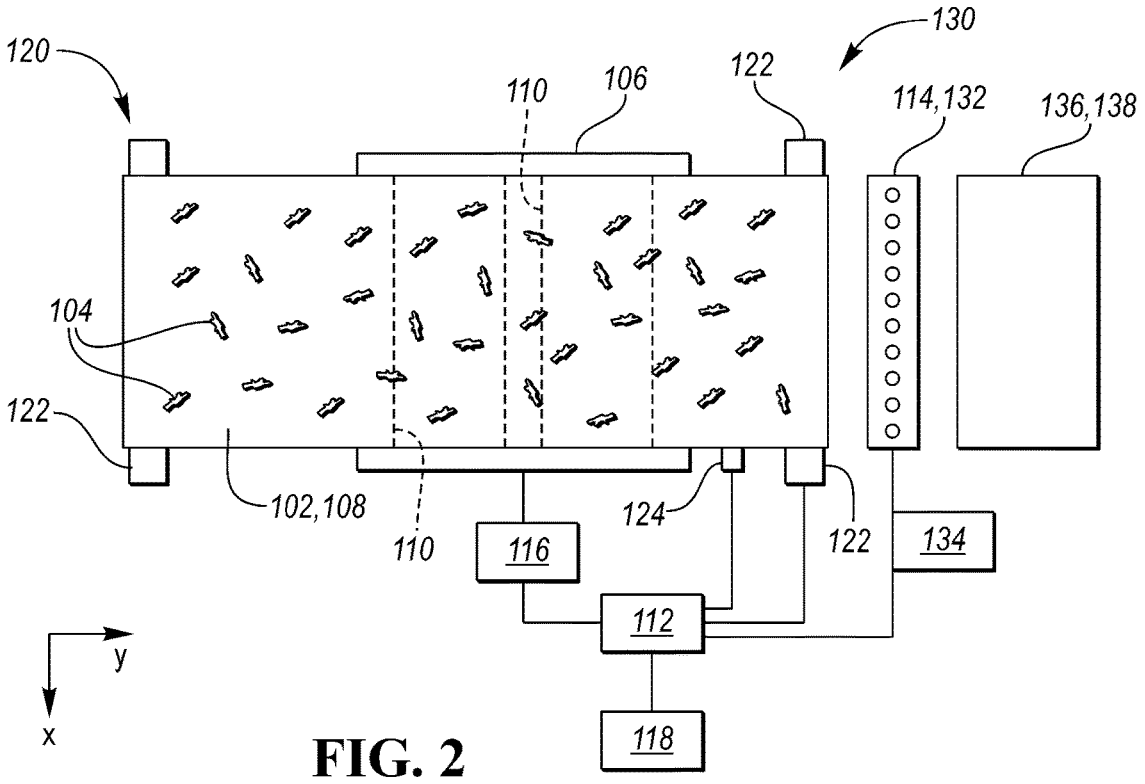
FIG. 2 illustrates a top schematic view of the sorting system of FIG. 1.
Figure 3:
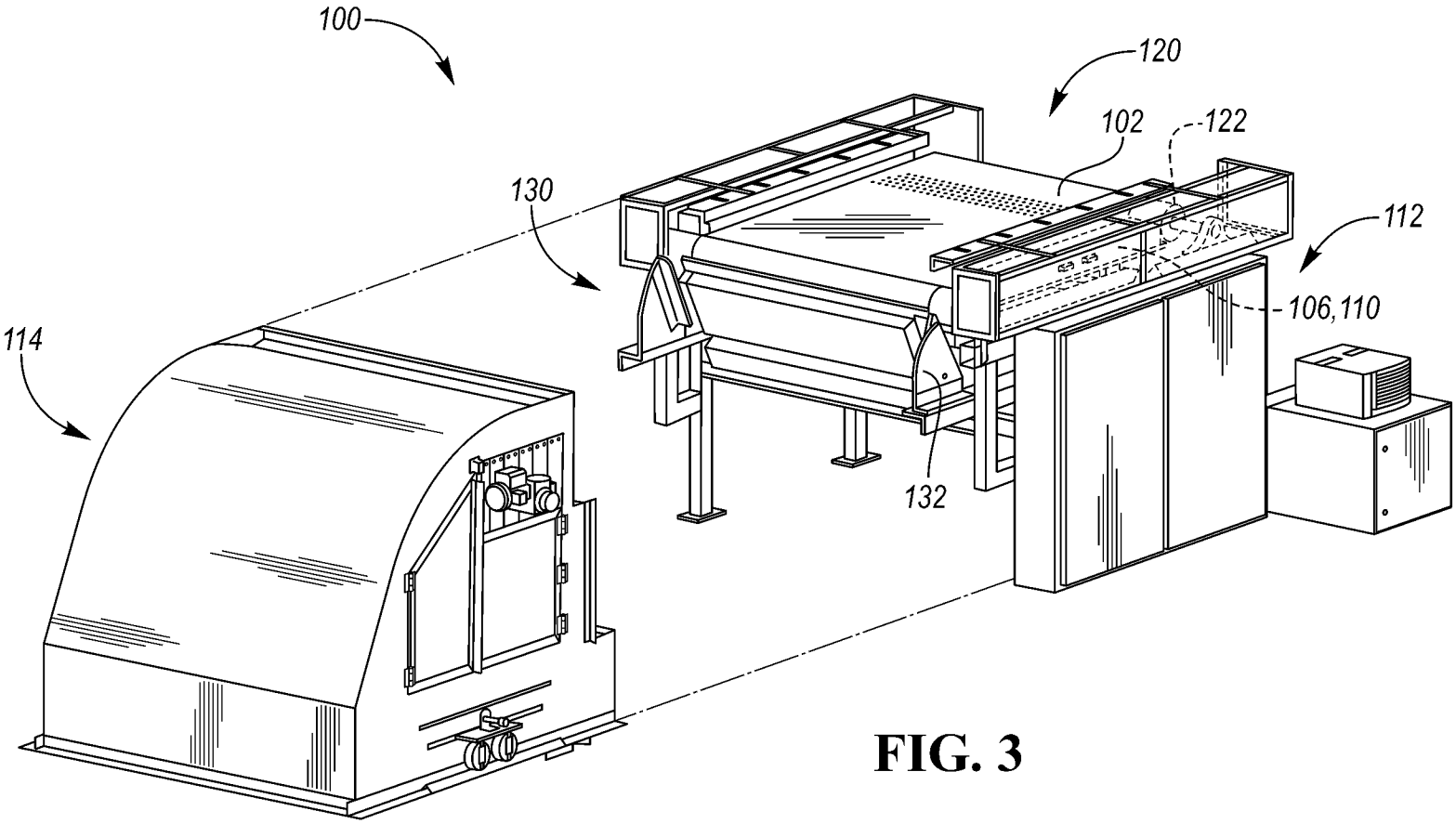
FIG. 3 illustrates an exploded perspective view of the sorting system of FIG. 1 according to an embodiment.

FIGS. 1-3 illustrate a system 100 or apparatus for classifying scrap materials into two or more classifications of materials, and then sorting the materials into their assigned classification. The system 100 may be a stand-alone apparatus. In other examples, the system 100 may be used or integrated with other classification and sorting systems, for example, in a larger line operation for classifying and sorting scrap materials.

A conveyor belt 102, or other mechanism for moving objects along a path or in a direction, shown here as the y-direction, supports particles 104 to be sorted. The particles 104 to be sorted are made up of pieces of scrap materials, such as scrap materials from a vehicle, airplane, consumer electronics, a recycling center; or other solid scrap materials as are known in the art. The materials 104 are typically broken up into smaller pieces on the order of centimeters or millimeters by a shredding process, or the like, before going through the sorting system 100 or a larger sorting facility. The particles 104 may be randomly positioned and oriented on the conveyor 102 in a single layer, have random and widely varying shapes, and have varying properties. The particles 104 may include mixed materials. In one example, the scrap material includes wire, and a particle 104 may include wire in various shapes, including three-dimensional shapes, and the wire may additionally be bare or insulated.

The system 100 classifies and sorts the particles into two or more selected categories of materials. In one example, a binary sort is performed to sort the materials 104 into two categories. In another example, the materials are sorted into three or more categories of materials. The conveyor belt 102 extends width-wise and transversely in the x-direction, and pieces or particles of material 104 are positioned at random on the belt 102. In various examples, different scrap materials may be sorted, e.g. metal versus non-metal, types of mixed metals, wire versus non-wire, etc.

A sensing apparatus or sensing assembly 106 is positioned adjacent to the conveyor belt 102. The sensing apparatus 106 is shown as being positioned below a region of the belt 102 containing particles 104, which provides a fixed distance D between the sensing apparatus 106 and the surface 108 of the belt 102 that supports the particles 104.

The sensing apparatus 106 has one or more sensor arrays 110. In the example shown, two sensor arrays 110 are shown; however, the system 100 may have a single array 110, or more than two arrays 110. Each array 110 includes a plurality of analog proximity sensors, as described in greater detail below, and the sensors in the array 110 provide an analog signal in response to sensing a particle 104 on the conveyor 102.

The sensors in each array 110 are provided as analog proximity sensors, as opposed to digital sensors. For an analog sensor, the signal output may vary and be any value within a range of values, for example, a voltage range. Conversely, with a digital signal, the signal output may only be provided as a binary signal, e.g. 0 or 1, or as one of a set of discrete, limited values. The sorting and classification system 100 of the present disclosure uses analog sensors to provide greater resolution in the signal. For example, the analog sensor may output a direct current voltage that varies between 0 and 12 Volts, and the signal may be any value within that range, e.g. 4.23 Volts. For a digital sensor, the signal output may be one of two discrete values, for example, that correspond to voltage values on either side of a set threshold value.

A control unit 112 receives the signals from the sensing apparatus 106 to locate, track, and classify particles 104 on the belt 102 for use in sorting the particles 104 into two or more classifications as the particles move along the belt. The control unit 112 may be provided by a networked computer system employing a plurality of processors to achieve a high-speed, multi-tasking environment in which processing takes place continuously and simultaneously on a number of different processors. In the control unit 112, each processor in turn is capable of providing a multi-tasking environment where a number of functionally different programs could be simultaneously active, sharing the processor on a priority and need basis. The choice of implementation of hardware to support the functions identified in the process groups may also depend upon the size and speed of the system, as well as upon the categories being sorted.

The control unit 112 may include a signal processing unit 116, for example to quantize and digitize the signals from the array 110 for use by control unit 112 in classifying and sorting the particles 104. The signal processing unit 116 may quantize and digitize the analog signal to maintain a predetermined resolution in the signal and data, for example, to tenths or hundredths of a volt, or may convert the analog signal to an 8-bit (or higher precision) value.

The control unit 112 controls the sensing assembly 106 using information regarding the position of the conveyor 102, for example, using inputs from the position sensor 124, to determine the linear advancement of the conveyor belt 102 and the associated advancement of the scrap particles 104 on the belt. The control unit 112 may control the processor 116 and sensing assembly 106 to acquire sensor data when the conveyor belt 102 has advanced a predetermined distance.

The control system 112 contains a data processing unit to acquire and process the signals and data from the sensor assembly 106. In one example, the data processing unit is integrated with the signal processing unit 116 and the control system 112, and in other embodiments, the data and signal processing units are separate. The processor unit includes logic for assembling the data from each sensor into a representation of the belt. The processor unit may represent a transverse section of the belt as a matrix of cells, and analyze the sensor data to determine locations of particles 104 on the conveyor 102, and to determine an input for each particle 104 for use in the classification and sorting process. The processor unit receives a signal indicative of the position of the conveyor 102 and when to acquire sensor data such that the conveyor belt is "imaged" in a series of discretized sections of the conveyor 102 as it passes across the sensor assembly 106 and array 110 and creates a matrix that is a linescan image of the belt. The controller 112 and processor may perform various analyses on the matrix as described below, or otherwise manipulate the sensor data to classify and sort the scrap materials 104.

The control unit 112 uses the quantized and digitized signals from the sensing assembly 106 to classify the particle 104 into one of two or more preselected classifications. Based on the classification outcome, the control unit 112 controls the separator unit 114 to sort the particles 104 based on their associated classifications. The control unit 112 may also include one or more display screens and a human machine interface 118, for use in controlling the system 100 during operation and also for use in calibration or system setup.

The scrap materials 104 may be shredded or otherwise processed before use with the system 100. Additionally, the scrap materials 104 may be sized, for example, using an air knife or another sizing system prior to use with the system 100. In one example, the scrap particles may be rough sorted prior to use with the system 100, for example, using a system containing digital inductive proximity sensors to classify and separate conductive from nonconductive materials, or using a magnetic sorting system to remove ferrous from non-ferrous materials. Generally, the scrap particles 104 are shredded and sized to have an effective diameter that is similar or on the same order as a sensor end face diameter. The particles 104 are then distributed onto the belt 102 as a single layer of dispersed particles to avoid overlap between particles, and provide separation between adjacent particles for both sensing and sorting purposes. The particles 104 may be dried prior to distribution, sensing, or sorting to improve efficiency and effectiveness of the sorting process.

In the present example, the system 100 uses analog inductive proximity sensors, such that the system is used to sort between two or more classes of metals, as the sensors can only detect electrically conductive materials. One advantage of the system 100 is that the scrap materials 104 do not need to be cleaned or washed prior to sorting. Additionally, the system 100 may be used to sort scrap material that includes particles 104 with mixed composition, for example, insulated wire or other coated wire. In various examples, the system 100 is used to sort between at least two of the following groups: metal wire, metal particles, and steel and/or stainless steel, where the metal particles have a conductivity that lies between the wire and steel/stainless steel groups and may include copper, aluminum, and alloys thereof. The system 100 may be used to sort scrap particles 104 having an effective diameter as large as 25 centimeters or more, and as small as 2 millimeters or 22-24 gauge wire. In other examples, the system 100 may be used to sort scrap particles 104 containing metal from scrap particles 104 that do not contain metal.

At least some of the scrap particles 104 may include stainless steel, steel, aluminum, titanium, copper, and other metals and metal alloys. The scrap particles 104 may additionally contain certain metal oxides with sufficient electrical conductivity for sensing and sorting. Additionally, the scrap particles 104 may be mixed materials such as metal wire that is coated with a layer of insulation, and other metals that are at least partially entrapped or encapsulated with insulation, rubber, plastics, or other nonconductive materials. Note that conductive as referred to within this disclosure means that the particle is electrically conductive, or contains metal. Nonconductive as referred to herein means electrically nonconductive, and generally includes plastics, rubber, paper, and other materials having a resistivity greater than approximately one mOhm·cm.

A scrap particle 104 provided by wire may be difficult to detect using other conventional classification and sorting techniques, as it typically has a low mass with a stringy or other convoluted shape and may be coated, which generally provides a low signal. The system 100 according to the present disclosure is able to sense and sort this category of scrap material.

The particles 104 of scrap material are provided to a first end region 120 of the belt 102. The belt 102 is moved using one or more motors and support rollers 122. The control unit 112 controls the motor(s) 122 to control the movement and speed of the belt 102. The motors and support rollers 122 are positioned such that the array 110 is directly adjacent to the belt 102 carrying the particles. For example, the belt 102 may be directly positioned between the particles 104 that it supports and an array 110 such that the array 110 is directly underneath a region of the belt 102 carrying particles 104. The motors and support rollers 122 may direct the returning belt below the array 110, such that the array 110 is positioned within the closed loop formed by the belt 102.

The control unit 112 may include or be in communication with one or more position sensors 124 to determine a location and timing of the belt 102 for use locating and tracking particles 104 as they move through the system on the belt. In one example, the conveyor 102 is linearly moved at a speed on the order of 200 to 800 feet per minute, although other speeds are contemplated. In a further example, the belt 102 has a linear speed of 400-700 feet per minute, and may have a speed of 400 feet per minute corresponding to a belt movement of 2 millimeters per millisecond, or 600 feet per minute corresponding to a belt movement of 3 millimeters per millisecond, or another similar speed.

Based on the signals received by the sensors in the array 110, the processing unit and control system 112 create a matrix that represents the belt 102 in a similar manner to a linescan image. If the sensors are not arranged in a single line, the times at which data is acquired into a "line scan" are appropriately compensated according to each sensor's distance along the Y direction, i.e. the direction of particle travel or movement of the belt 102. The control system 112 and processing unit acquires and processes the signals from the sensors in the array 110 and sensing assembly 106 to create the matrix or linescan image. The matrix is formed by a series of rows, with each row representing a narrow band of the belt that extends the width of the belt 102. Each row is divided into a number of cells, and the processing unit enters data from the sensors into the cells such that the matrix is a representation of the conveyor belt 102, e.g. the matrix represents discretized sections or locations of the conveyor 102 as it passes across the array 110.

The control unit 112 uses the signals from the sensors in the array 110 as described below to identify particles 104 on the belt 102 and classify each particle 104 into one of a plurality of classifications. The control unit 112 then controls the separator unit 114, using the classification for each particle 104, the location of the particles, and the conveyor belt 102 position to sort and separate the particles 104.

The system 100 includes a separator unit 114 at a second end 130 of the conveyor 102. The separator unit 114 includes a system of ejectors 132 used to separate the particles 104 based on their classification. The separator unit 114 may have a separator controller 134 that is in communication with the control system 112 and the position sensor 124 to selectively activate the appropriate ejectors 132 to separate selected scrap particles 104 located on the conveyor which have reached the discharge end 130 of the belt. The ejectors 132 may be used to sort the particles 104 into two categories, three categories, or any other number of categories of materials. The ejectors 132 may be pneumatic, mechanical, or other as is known in the art. In one example, the ejectors 132 are air nozzles that are selectively activated to direct a jet of air onto selected scrap particles 104 to alter the trajectory of the selected particle as it leaves the conveyor belt so that the particles are selectively directed and sorted into separate bins 136, for example using a splitter box 138.

A recycle loop may also be present in the system 100. If present, the recycle loop takes particles 104 that could not be classified and reroutes them through the system 100 for rescanning and resorting into a category.

Figure 4B:
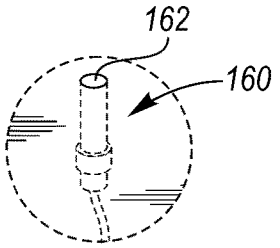
FIGS. 4A and 4B illustrate a perspective view of a sensor assembly and a sensor, respectively, for use with the sorting system of FIG. 3.
Figure 4A:
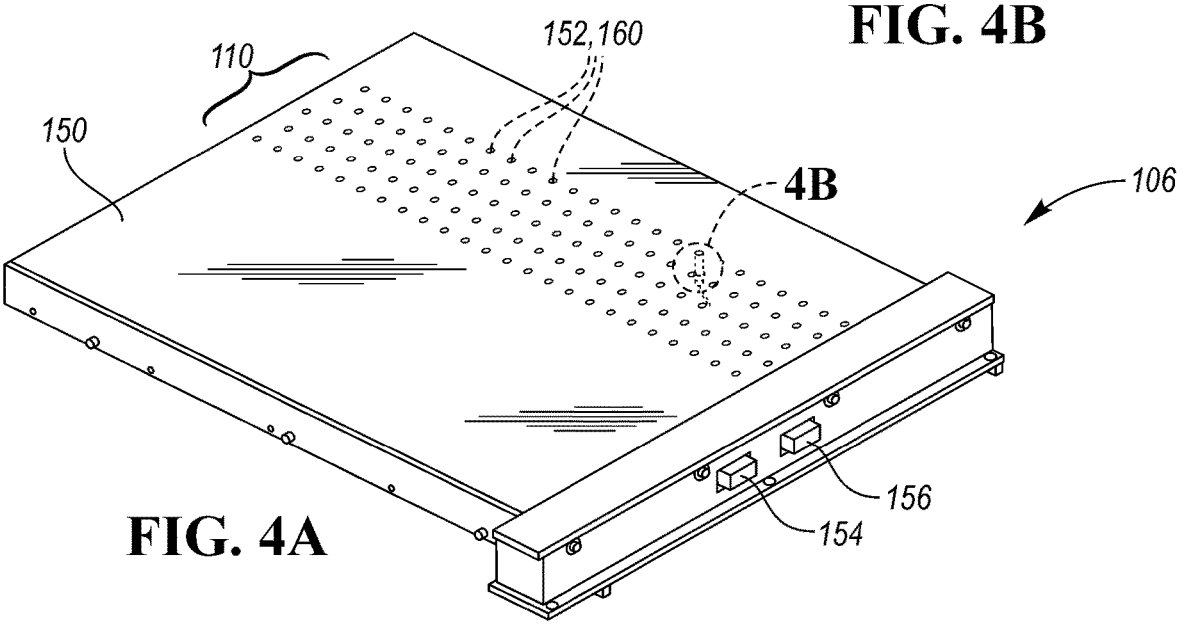
Figure 5:
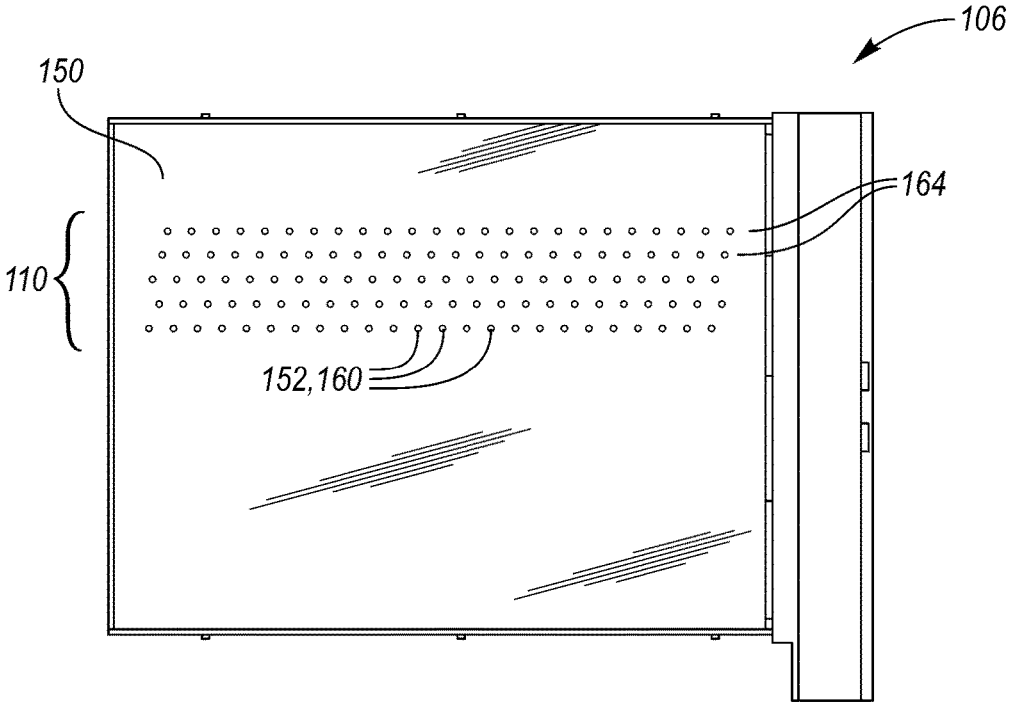
FIG. 5 illustrates a top view of the sensor assembly of FIG. 4.

FIGS. 4A, 4B, and 5 illustrate a sensing assembly 106 according to an embodiment. FIG. 4B illustrates an inset, enlarged perspective view of a sensor 160 in the assembly 106. In one example, the sensing assembly 106 may be used with system 100 as described above with respect to FIGS. 1-3. The sensing assembly 106 is illustrated as having one sensor array 110. One sensing assembly, or more than one sensing assembly may be used with the system 100.

The sensing assembly 106 has a base member 150 or sensor plate. The base member 150 is sized to extend transversely across the conveyor belt 102 and is shaped to cooperate with a corresponding mount for the sensing assembly 106 in the system 100 to be supported within the system 100.

The base member 150 defines an array of apertures 152 that intersect the upper surface, with each aperture sized to receive a corresponding sensor 160 in the array 110 of analog proximity sensors. In other embodiments, other structure or supports may be used to position and fix the sensors into the array in the assembly. The base member 150 provides for cable routing for a wiring harness 154 to provide electrical power to each of the sensors 160 and also for a wiring harness 156 to transmit analog signals from each of the sensors 160 to the signal processing unit 116 and the control unit 112.

Each sensor has an end surface or active sensing surface 162. The sensors 160 are arranged into an array 110 such that the end surfaces 162 of each of the sensors are co-planar with one another, and lie in a plane that is parallel with the surface 108 of the belt, or generally parallel to the surface of the belt, e.g. within five degrees of one another, or within a reasonable margin of error or tolerance. The end faces 162 of the sensors likewise generally lie in a common plane, e.g. within an acceptable margin of error or tolerance, such as within 5-10% of a sensor end face diameter of one another or less. The sensors 160 are arranged in a series of rows 164, with sensors in one row offset from sensors in an adjacent row. The sensors 160 in the array 110 are arranged such that, in the X-position or transverse direction and ignoring the Y-position, adjacent sensors have overlapping or adjacent electromagnetic fields. The sensors 160 may be spaced to reduce interference or crosstalk between adjacent sensors in the same row 164, and between sensors in adjacent rows 164. In one example, all of the sensors 160 in the array are the same type and size of sensor. In other examples, the sensors 160 in the array may be different sizes, for example, two, three, or more different sizes.

The sensors 160 may be selected based on the side of the active sensing area, or a surface area of the end face 162. The sensors are also selected based on their sensitivity and response rate. In one example, the end face 162 area generally corresponds with or is on the same order as the size of the particles 104 to be sorted, for example, such that the sensor is used to sort particles having a projected area within 50%, 20%, or 10% of the sensor surface area. For example, the sensor end surface 162 area may be in the range of 2 millimeters to 25 millimeters, and in one example is on the order of 12-15 or 15-20 millimeters for use with scrap particles 104 having an effective diameter in the same size range, e.g. within a factor of two or more. Therefore, although the scrap materials 104 may undergo a rough sorting process prior to being distributed onto the belt, the system 100 allows for size variation in the scrap particles.

The sensors 160 may be selected based on the materials to be sorted. In the present example, the sensors 160 in the array 110 are each inductive analog proximity sensors, for example, for use in detecting and sorting metals. The sensor 160 creates an induction loop as electric current in the sensor generates a magnetic field. The sensor outputs a signal indicative of the voltage flowing in the loop, which changes based on the presence of material 104 in the loop and may also change based on the type or size of metal particles, or for wire versus solid particles. The control unit 112 may use the amplitude of the analog voltage signal to classify the material. In further examples, the control unit 112 may additionally or alternatively use the rate of change of the analog voltage signal to classify the material.

The analog inductive proximity sensors 160 are arranged into rows 164 in an array 110, with each row 164 positioned to extend transversely across the sensor assembly 106 and across a belt 102 when the sensor assembly in used with the system 100. Each row 164 in the array 110 may have the same number of sensors 160 as shown, or may have a different number. The sensors 160 in each row 164 are spaced apart from one another to reduce interference between sensors. The spacing between adjacent rows 164 is likewise selected to reduce interference between sensors in adjacent rows. The sensors 160 in one row 164 are offset from the sensors 160 in an adjacent row 164 along a transverse direction as shown to provide sensing coverage of the width of the belt.

In the present example, the array 110 includes five rows 164 of sensors 160, with each row having 24 identical analog inductive proximity sensors, with each sensor having an end face diameter of 18 millimeters. The array 110 therefore contains 120 sensors. The sensors 160 in each row 164 are spaced apart from one another by approximately five times the diameter of the sensor to reduce crosstalk and interference between the sensors. The number of sensors 160 in each row is therefore a function of the diameter of the sensor and the length of the row which corresponds to the width of the belt. The number of rows 164 is a function of the width of the belt, the number and size of sensors, and the desired sensing resolution in the system 100. In other examples, the rows may have a greater or fewer number of sensors, and the array may have a greater or fewer number of rows, for example, 10 rows.

In the present example, each row 164 is likewise spaced from an adjacent row by a similar spacing of approximately five times the diameter of the sensor 160. The sensors 160 in one row 164 are offset transversely from the sensors in adjacent rows, as shown in FIGS. 4-5. The sensors 160 in the array as described provide for a sensor positioned every 12.5 mm transversely across the belt when the sensor 160 positions are projected to a common transverse axis, or x-axis, although the sensors 160 may be at different longitudinal locations in the system 100. The control unit therefore uses a matrix or linescan image with 120 cells in a row to correspond with the sensor arrangement in the array. A scrap particle 104 positioned at random on the belt is likely to travel over and interact with an electromagnetic field of at least two sensors 160 in array. Each sensor 160 has at least one corresponding valve or ejector 132 in the blow bar of the sorting assembly.

The end faces 162 of the sensors in the array lie in a single common plane, or a sensor plane. This plane is parallel to and spaced apart from a plane containing the upper surface 108 of the belt, or a belt plane. The sensor plane is spaced apart from the belt plane by a distance D, for example, less than 5 millimeters, less than 2 millimeters, or one millimeter. Generally, improved sorting performance may be provided by reducing D. The distance D that the sensor plane is spaced apart from the belt plane may be the thickness of the belt 102 with an additional clearance distance to provide for movement of the belt 102 over the sensor array 110.

The sensors 160 in the array 110 may all be operated at the same frequency, such that a measurement of the direct current, analog, voltage amplitude value is used to classify the materials. In other examples, additional information from the sensor 160 may be used, for example, the rate of change of the voltage. As a scrap particle 104 moves along the conveyor belt 102, the particle traverses across the array 110 of sensors. The particle 104 may cross or traverse an electromagnetic field of one or more of the sensors 160 in the array. As the particle 104 enters a sensor electromagnetic field, the electromagnetic field is disturbed. The voltage measured by the sensor 160 changes based on the material or conductivity of the particle, and additionally may change based on the type or mass of material, e.g. wire versus non-wire. As the sensor 160 is an analog sensor, it provides an analog signal with data indicative of the amplitude of the direct current voltage measured by the sensor 160 that may be used to classify the particle.

As the particles 104 are all supported by and resting on the conveyor belt 102, the scrap particles all rest on a common belt plane that is coplanar with the sensor plane of the sensor array 110. As such, the bottom surface of each particle is equidistant from the sensor array as it passes overhead by the distance D. The scrap particles in the system 100 have a similar size, as provided by a sizing and sorting process; however, there may be differences in the sizes of the scrap particles, as well as in the shapes of the particles such that the upper surface of the particles on the belt may be different distances above the sensor array. The particles therefore may have a thickness, or distance between the bottom surface in contact with the belt and the opposite upper surface that is different between different particles being sorted by the system 100. The scrap particles interact with the sensors in the array to a certain thickness, which corresponds with a penetration depth of the sensor as determined by the sensor size and current.

Figure 6:
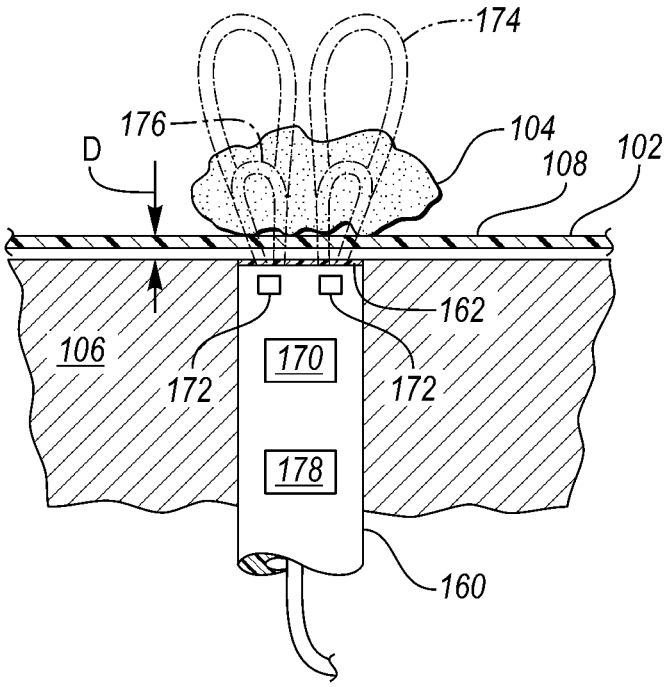
FIG. 6 illustrates a schematic of a sensor interacting with a scrap particle.

FIG. 6 illustrates a partial schematic cross-sectional view of a sensor 160 in an array 110 and a particle 104 on a belt 102. As can be seen from the Figure, the upper surface 108 of the belt 102, or belt plane, is a distance D above a sensor plane containing the end face 162 of the sensor 160. The sensor 160 contains an inductive coil 172 made from turns of wire such as copper and an electronics module 170 that contains an electronic oscillator and a capacitor. The sensor 160 receives power from an outside power supply. The inductive coil 172 and the capacitor of the electronics module 170 produce a sine wave oscillation at a frequency that is sustained via the power supply. An electromagnetic field is produced by the oscillation and extends out from the end face 162, or the active surface 162 of the sensor 160. An electromagnetic field that is undisturbed by a conductive particle, e.g. when there is no scrap material on the belt 102, is shown at 174. When a scrap particle 104 containing a conductive material, such as metal, enters the electromagnetic field, some of the oscillation energy transfers into the scrap particle 104 and creates eddy currents. The scrap particle and eddy current result in a power loss or reduction in the sensor 160, and the resulting electromagnetic field 176 has a reduced amplitude. The amplitude, e.g. the voltage, of the sensor 160 is provided as a signal out of the sensor via the output 178. Note that for an analog sensor, the sensor 160 may continually provide an output signal, for example, as a variable voltage within a range of voltages, that is periodically sampled or acquired by the control unit 112.

Figure 7:
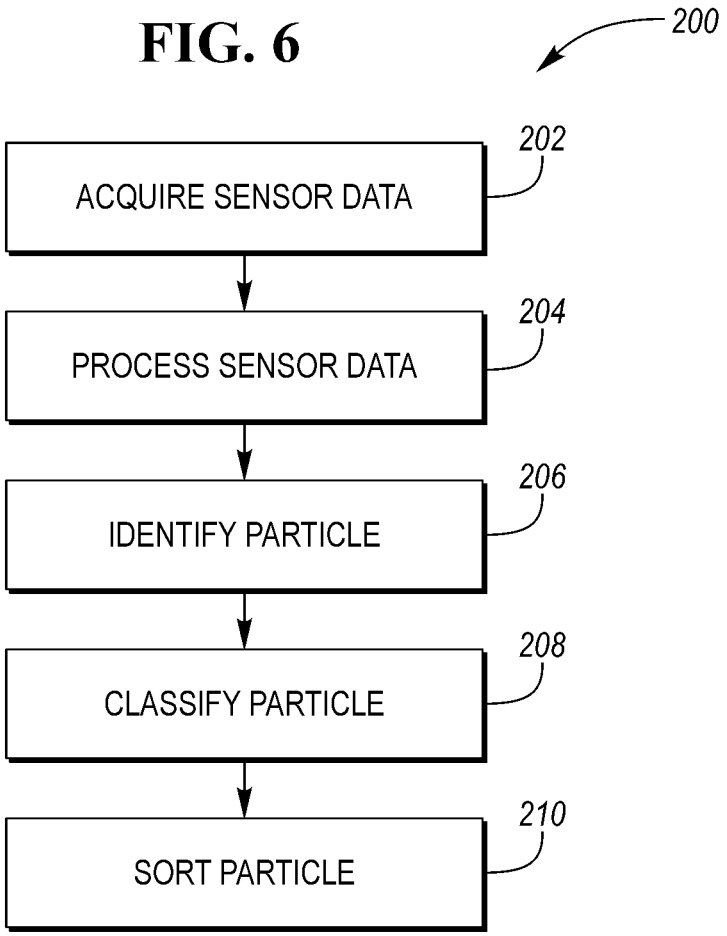
FIG. 7 illustrates a flow chart illustrating a method for classifying scrap material using the system of FIG. 1.

Referring to FIG. 7, a method 200 is shown for classifying particles 104 using the control unit 112 of the system 100 and sensor assembly 106 as shown in FIGS. 1-5. In other embodiments, various steps in the method 200 may be combined, rearranged, or omitted.

At 202, the control unit 112 and processing unit acquire data from a row 164 of sensors based on the position of the conveyor 102.

As the control unit 112 and processing unit receives the data from the sensors 160, the control unit 112 and processor forms a matrix or linescan image associated with sensor array 110 that is also linked to the position or coordinates of the belt 102 for use by the separator unit 114 as shown at 204. The processor receives data from the sensor array 110, with a signal from each sensor 160 in the array. The processor receives signals from the sensors, and based on the position of the belt 102, for example, as provided by a digital encoder, inputs data from selected sensors into cells in the matrix. The matrix provides a representation of the belt 102, with each cell in the matrix associated with a sensor 160 in the array. In one example, the matrix may have a line with a cell associated with each sensor in the array, with the cells ordered as the sensors are ordered transversely across the belt when projected to a common transverse axis. Therefore, adjacent cells in a line of the matrix may be associated with sensors 160 in different rows in the array.

The control unit and processor receives the digitized direct current voltage signal or quantized value from the analog inductive sensor 160. In one example, the quantized value may be a 8-bit greyscale value ranging between 0-255. The sensor 160 may output any value between 0-12, 0-11, 0-10 Volts or another range based on the sensor type, and based on the sensor voltage output, the processor assigns a corresponding bit value. In one example, zero Volts is equivalent to a quantized value of zero. In other examples, zero Volts is equivalent to a quantized value of 255. In other examples, the processor may use other quantized values, such as 4 bit, 16 bit, 32 bit, may directly use the voltage values, or the like.

The cells in the matrix are populated with a peak voltage as measured by the sensor 160 within a time window or at a timestamp. In other examples, the sensor signal data may be post-processed to reduce noise, for example, by averaging, normalizing, or otherwise processing the data.

The processor and control unit 112 may use a matrix with cells containing additional information regarding particle location, and particle properties as determined below. The processor and control unit 112 may alternatively use an imaging library processing tool, such as MATROX, to create a table or other database populated with signal data for each particle including quantized 8-bit voltage values, boundary information, and other particle properties as described below with respect to further embodiments.

At 206, the control unit 112 identifies cells in the matrix that may contain a particle 104 by distinguishing the particle from background signals indicative of the conveyor 102. The particle 104 may be distinguished from the background when a group of adjacent cells have a similar value, or values within a range, to indicate the presence of a particle 104 or when a single cell is sufficiently different from the background. The controller 112 then groups these matrix cells together and identifies them as a "grouping" indicative of a particle.

At 208, the controller 112 determines an associated classification input or quantized value input for each grouping. For example, the controller 112 may use a peak voltage from a cell associated with the grouping as the classification input, for example, the highest or lowest cell voltage or quantized value in the grouping. In other examples, the controller calculates the classification input for the grouping as a sum of all of the values in the grouping, an average of all of the cells in the grouping, as an average of the peak voltages or quantized values from three cells in the grouping, an average of the peak voltages or quantized values from three contiguous cells, or the like. By grouping the data together into a single unit or classification input to represent the particle, and making a decision on the particle as a whole, increased accuracy may be obtained in comparison with a more conventional practice in scrap sorting with each sensor and associated ejector operating as a separate, independent unit from other sensors and ejectors.

At 210, the control unit 112 controls the separator unit 114 to selectively activate an ejector 132 to eject a particle into a desired bin based on the classification for the particle. The control unit 112 controls the ejectors 132 based on the classification of the particle 104 from the cells in the matrix and grouping associated with the particle and based on the position and timing of the conveyor 102.

Figure 8A:
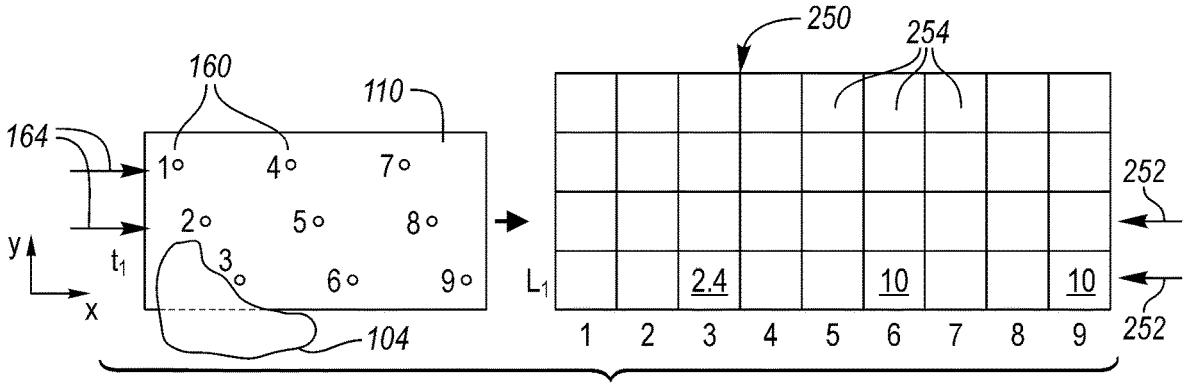
FIGS. 8A-8D illustrate a simplified example of a matrix for the conveyor belt as created by the control system for use in identifying and classifying a particle of scrap material as it passes over a sensor array.

FIGS. 8A-8D illustrate a simplified example of the method 200 as implemented by the system 100. In FIG. 8, the sensor array 110 includes three rows 164, with three sensors 160 in each row, and the sensors in different rows being offset from one another. The sensors 160 are labeled as sensors 1-9 as shown in FIG. 8A based on the sensor position projected along a transverse axis x. A scrap particle 104 is illustrated at time t1 in FIG. 8A, time t2 in FIG. 8B, time t3 in FIG. 8C, and time t4 in FIG. 8D, which corresponds to sequential times that the control system 112 is acquiring sensor data based on belt 102 movement.

A matrix 250 is created by the control unit and processor 112, and has a line (L) 252 associated with each time, and n cells 254 in each row, where n is equal to the number of sensors in the array, or nine in the present example. The cells 254 are labeled 1-9 to correspond with the sensors 1-9.

The control unit 112 fills line L1 of the matrix with a peak voltage value or equivalent classification value, such as 8-bit value as the particle passes over the array 110. The cells in the matrix 250 that are being filled at each timestep have an underlined value within the cell. In the present example, a sensor 160 that is not sensing a conductive scrap particle has a voltage of 10 Volts, and the particle as shown in FIG. 4 is formed from a metal, such as steel or stainless steel with a peak sensor voltage of approximately 2.5 Volts, although this may vary based on the thickness of the particle 104 over the sensor 160, whether the particle is traveling through the entire electromagnetic field of a sensor 160 or only a portion thereof, etc. The voltage values as shown in the matrix 250 are truncated for simplicity, and in further examples, may be measured to the tenth or hundredth of a volt. Conversely, for a 8-bit classification value, 10 volts may be a quantized value of 0, with zero Volts having a quantized value of 255, and a voltage of 2.5 Volts having an associated quantized value of 191.

In FIG. 8A, control unit 112 and processor begin to fill line L1 in the matrix 250. At time t1, the system 100 has just started such that the matrix 250 was empty or cleared. The particle 104 is overlaying sensor 3, while the particle is sufficiently far from sensors 6 and 9 such that the voltage for these sensors is unaffected at 10 Volts. Therefore, the control unit 112 inputs the analog peak voltage from sensors 3, 6, and 9 into line L1 of the matrix as shown.

Figure 8B:
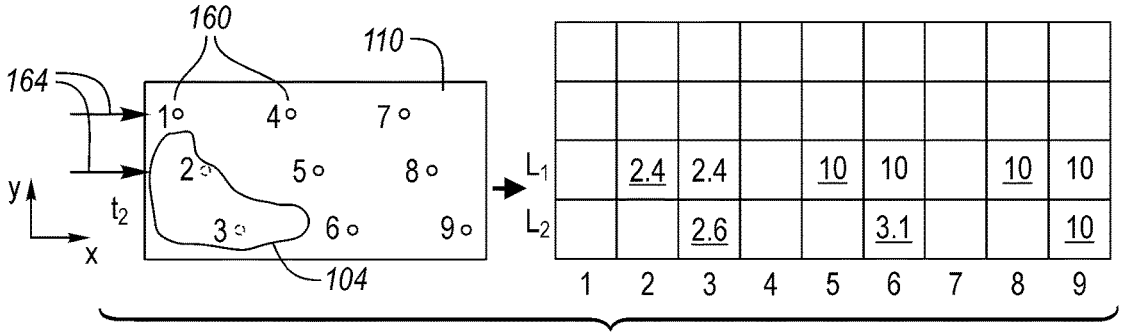

In FIG. 8B, the belt and particle 104 have advanced, and the control unit 112 populates the matrix 250 at time t2. In one row 164 of sensors, the particle 104 is overlaying sensor 3 and 6 and the particle is sufficiently far from sensor 9 such that the voltage is unaffected; and the control unit 112 inputs the analog peak voltage from sensors 3, 6, and 9 into line L2 of the matrix 250 as shown. In another row 164 of sensors, the particle 104 is overlaying sensor 2, while the particle is sufficiently far from sensors 5 and 8 such that the voltage is unaffected; and the control unit 112 inputs the analog peak voltage from sensors 2, 5, and 8 into line L1 of the matrix 250 as shown.

Figure 8C:
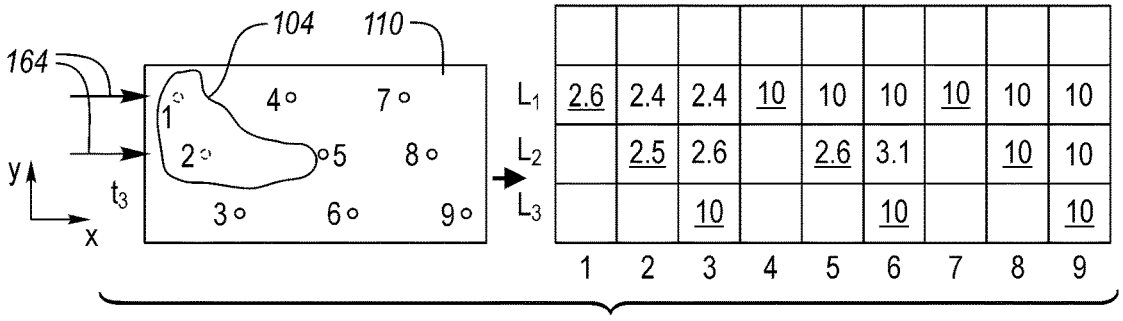

In FIG. 8C, the belt and particle 104 have advanced, and the control unit 112 populates the matrix 250 at time t3. In one row 164 of sensors, the particle 104 is sufficiently far from sensors 3, 6, and 9 such that the voltage is unaffected; and the control unit 112 inputs the analog peak voltage from sensors 3, 6, and 9 into line L3 of the matrix 250 as shown. In another row 164 of sensors, the particle 104 is overlaying sensor 2 and 5 and the particle is sufficiently far from sensor 8 such that the voltage is unaffected; and the control unit 112 inputs the analog peak voltage from sensors 2, 5, and 8 into line L2 of the matrix 250 as shown. In another row of sensors, the particle 104 is also overlaying sensor 1, while the particle is sufficiently far from sensors 4 and 7 such that the voltage is unaffected; and the control unit 112 inputs the analog peak voltage from sensors 1, 4, and 7 into line L1 of the matrix 250 as shown.

Figure 8D:
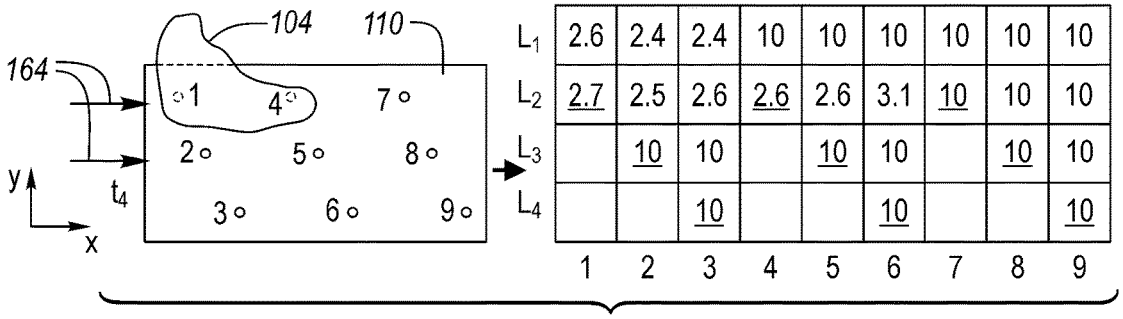

In FIG. 8D, the belt and particle 104 have advanced, and the control unit 112 populates the matrix 250 at time t4. As can be seen from the matrix 250, the L1 line is completed and is unchanged. In one row 164 of sensors, the particle 104 is sufficiently far from sensors 3, 6, and 9 such that the voltage is unaffected; and the control unit 112 inputs the analog peak voltage from sensors 3, 6, and 9 into line LA of the matrix as shown. In another row of sensors, the particle 104 is sufficiently far from sensors 2, 5, and 8 such that the voltage is unaffected; and the control unit 112 inputs the analog peak voltage from sensors 2, 5, and 8 into line L3 of the matrix 250 as shown. In another row of sensors, the particle 104 is overlaying sensors 1 and 4, and the particle is sufficiently far from sensor 7 such that the voltage is unaffected; and the control unit 112 inputs the analog peak voltage from sensors 1, 4, and 7 into line L2 of the matrix 250 as shown.

As seen in FIG. 8D, a grouping of cells in lines L1 and L2 generally indicates the presence, location, and shape of a particle 104 such that the control unit 112 may identify the grouping as a particle and use data within cells 1, 2, and 3 in line L1 and cells 1-5 or 1-6 in line L2 to classify and sort the particle 104. In other examples, a particle may be shaped or sized such that only one or two sensors in the array detect the particle.

The matrix 250 may have a set number of lines (L), or n lines, with n being larger than the number of rows 164 of sensors and/or larger than the time steps. As the data in the lines in the matrix shift with time and new data is filled in, eventually the original or earlier data may be deleted or cleared. For example, in a matrix 250 with n lines, when after data is acquired at time tn, the data from L1 would be cleared at the next timestep tn+1.

The control unit 112 may undergo a calibration process to set the criteria for the various classifications. First and second particles 104 formed from known materials of each of the selected classifications for a binary sort are provided through the system 100. In other examples, a third particle from a third classification may additionally be provided for a tertiary sort.

The system 100 may be operated in various modes based on the materials to be sorted and the associated classifications. The operator may select the mode using the HMI 118. In one example, the system 100 incorporates multiple arrays 110 running different modes in series. Note that for a system 100 using analog inductive proximity sensors, the system 100 is unable to detect, or classify electrically nonconductive material.

In a first mode of operation, the control system 112 is sorting between conductive materials, and may be sorting using either binary or tertiary classifications based on the following groups: conductive wire, steel and stainless steel, and other metals. The system 100 is therefore classifying and sorting anything with a signature. The control system 112 fills the matrix 250 using the full voltage range of the sensors 160, e.g. 0-10 Volts, or alternatively, sets and uses the 8-bit classification value based on the 0-10 Volts range, such that each bit has an associated 0.04 Volt size range or resolution. The control unit 112 classifies the particles 104 based on the peak voltage in a cell of the grouping compared to various voltage ranges, or another criteria. The control unit may additionally use area of the grouping as a classification parameter.

In a second mode of operation, the control system 112 is sorting between conductive wire and conductive non-wire materials. The control system 112 fills the matrix using a reduced selected voltage range of the sensors, e.g. 4-10 or 5-10 Volts, which targets the sensor voltage values associated with wire and ignores sensor values that are below the range. The control system 112 then classifies the particles 104 as generally described above with respect to the first mode.

In a third mode of operation, the control system 112 is sorting between conductive metals, e.g. between steel or stainless steel and other conductive metals such as copper and aluminum or alloys thereof. The control system 112 fills the matrix 250 using a reduced selected voltage range of the sensors, e.g. 0-1, 0-2, 0-3 or 0-4 Volts, which targets the sensor signals and voltage values associated with metals and ignores sensor voltage values that are above the range. For example, in the system 100 as described stainless steel has an associated voltage signature of 1 Volt, while copper and aluminum have higher voltage signatures of 3-4 volts. The control system 112 may additionally step up the voltages from the sensors 160 based on the low values before using the data to fill the matrix 250. The control system may be able to therefore distinguish between different metals, or even different alloys.

In a fourth mode, the control system 112 may use the system 100 to sort scrap particles that contain metal from scrap particles that contain no metal or electrically conductive material. The control system 112 classifies anything with a voltage signal different than the baseline voltage signal as a metal-containing particle and controls the ejectors to sort these particles into a bin.

In all of the modes, the controller 112 uses the analog signal from a single array 110 of sensors 160 lying in a sensor plane that is parallel to the belt. The control system 112 uses the variability signal of the analog sensor to provide information related to the conductivity, and therefore the classification of the material. Conventional systems may use a series of arrays of digital proximity sensors, with the sensors in each array set at different thresholds, typically by turning a potentiometer, to provide a signal, and/or set at different distances from the belt to sort based on a cutoff strategy. In the system 100 of the present disclosure, there is no need to adjust the distance between the belt and the sensors when changing the sortation feed materials or production strategy. The sensor array remains fixed relative to the belt, and a different program or sorting method may be selected or loaded into the controller 112 for a change in feed materials or production strategy.

Figure 9:
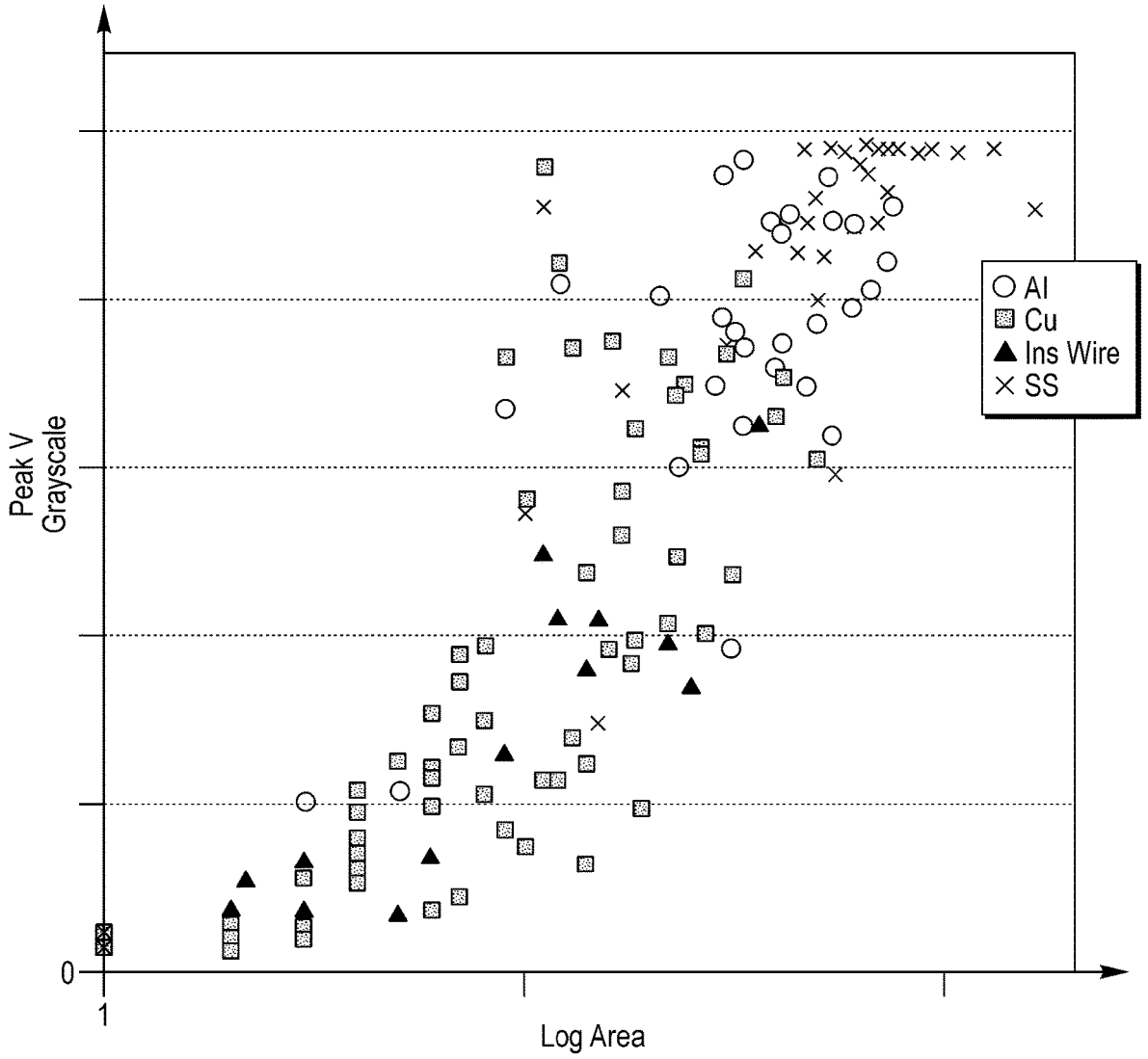
FIG. 9 is a plot of sample data for use is setting calibration and classification parameters.

FIG. 9 illustrates sample calibration data from the system 100 that included stainless steel, copper, aluminum, and insulated wire. The data is plotted with the area or number of cells in the matrix associated with a particle versus peak voltage for a cell in the matrix identified as the particle. The data from FIG. 9 may be used to set voltage ranges for associated classifications of materials for use by the control system in classifying and sorting materials.

Figure 10:
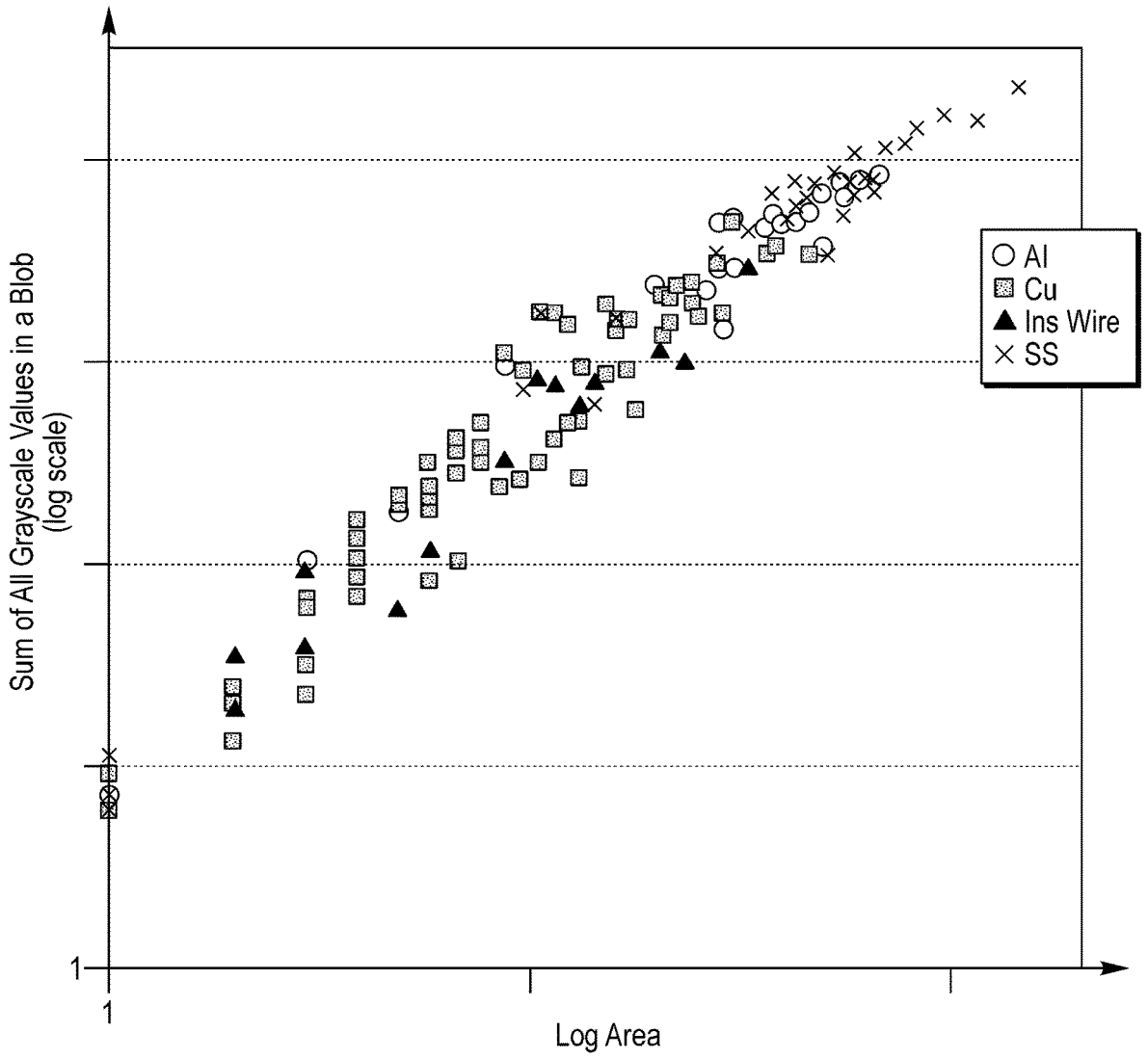
FIG. 10 is another plot of sample data for use in setting calibration and classification parameters.

FIG. 10 illustrates sample calibration data from the system 100 that included stainless steel, copper, aluminum, and insulated wire. The data is plotted with the area or number of cells in the matrix associated with a particle versus the sum of the 8-bit classification values in the grouping in the matrix identified as the particle. The data from FIG. 10 may be used to set voltage ranges for associated classifications of materials for use by the control system in classifying and sorting materials.

In a further example, the controller 112 may also determine a secondary classification input for use in classification of the particle 104 from the matrix 250 data. In one example, the rate of change of the sensor voltage is used as a secondary classification input. In another example, the secondary classification input may be based a calculated shape, size, aspect ratio, texture feature, voltage standard deviation, or another characteristic of the grouping or identified particle from the sensor data in the matrix as a secondary feature for the particle. For example, the secondary classification input may be provided by a sum of the voltages over the area associated with the particle region, an area ratio factor as determined using a particle area divided by a bounding box area, a compactness factor as determined as a function of the particle perimeter and the particle area, and the like. Texture features may include rank, dimensionless perimeter (perimeter divided by square root of area), number of holes created by thresholding the particle or by subtracting one rank image from another, total hole area as a proportion of total area, largest hole area as a proportion of area, and Haralick texture features. Texture values may be obtained for a grouping by transforming the matrix via a fast Fourier transform (FFT). The average log-scaled magnitude in different frequency bands in the FFT magnitude image may be used as distinguishing texture features. Some secondary classification features, such as texture, may only be obtained with the use of sensors that are smaller than the particle sizing to provide increased resolution and the data required for this type of analysis.

The secondary classification input may be used alone to classify the particle. Alternatively, with a secondary classification input, the control unit 112 may generate a data vector for each grouping or identified particle that includes both the voltage based classification input, as well as one or more secondary classification inputs. In this scenario, the control unit would then classify the particle as a function of the data vector by inputting the data vector into a machine learning algorithm. The control unit may use a Support Vector Machine (SVM), a Partial Least Squares Discriminant Analysis (PLSDA), a neural network, a random forest of decision trees, or another machine learning and classification technique to evaluate the data vector and classify the particle 104. In one example, a neural network is used to classify each of the scrap particles 104 as one of a preselected list of alloy families or other preselected list of materials based on elemental or chemical composition based on the analysis of the sensor and matrix data. In other examples, the control unit may use a look-up table that plots the data vectors and then classifies the grouping based on one or more regions, thresholds, or cutoff planes. In one example, the classification of a particle 104 may be a multiple stage classification.

In one example, the control unit 112 inputs the data vector into a neural network to classify the particle. The neural network program may be "trained" to "learn" relationships between groups of input and output data by running the neural network through a "supervised learning" process. The relationships thus learned could then be used to predict outputs (i.e., categorize each of the scrap particles) based upon a given set of inputs relating to, for example, classification inputs, datasets, histograms, etc. produced from representative samples of scrap having known chemistry.

The control unit 112 may use a neural network and analyzing/decision-making logic to provide a classification scheme for selected scrap materials to classify the materials using a binary classification system, or classify the particle into one of three or more classifications. Commercially available neural network configuration tools may be employed to establish a known generalized functional relationship between sets of input and output data. Known algorithmic techniques such as back propagation and competitive learning, may be applied to estimate the various parameters or weights for a given class of input and output data. Once the specific functional relationships between the inputs and outputs are obtained, the network may be used with new sets of input to predict output values. It will be appreciated that once developed, the neural network may incorporate information from a multitude of inputs into the decision-making process to categorize particles in an efficient manner.

In various embodiments, a system is provided to sort randomly positioned scrap material particles on a moving conveyor, where at least some of the scrap particles comprise metal. The system includes a conveyor belt for carrying at least two categories of scrap particles positioned at random, with the conveyor belt traveling in a first direction. The sensor array has a series of analog proximity sensors, with an active sensing end face of each sensor lying in a sensing plane, the sensing plane being parallel with and directly adjacent to the conveyor. The sensor array has at least one row of sensors, with each row of sensors extending transversely across the belt. The sensors in one row may be offset transversely from sensors in an adjacent row. The system has a control system configured to receive and process analog signals from the series of proximity sensor to identify and locate a scrap particle on the conveyor passing over the array. The control system creates a linescan image (or matrix) corresponding to a physical location on the conveyor by analyzing the analog signals from the sensor array. The analog signals provide a variable signal within a range of signal values, and may be sampled and quantized such that the analog signal retains at least 4 bit, 8 bit, 16 bit, or higher signal resolution. The control system inputs a value based on the analog signal into a cell of the matrix, with each cell in the matrix corresponding to an associated analog sensor in the array. The control system identifies cells in the matrix containing a particle by distinguishing the particle from a background indicative of the conveyor, and calculates a classification input for the particle based on the values for each cell in the matrix associated with the particle. The control system then classifies the particle into one of the at least two classifications of scrap materials using the classification input. The control system may compare the classification input for the particle to one or more thresholds that are selected based on the at least two classifications of scrap materials to be sorted. In further examples, the control system uses a first voltage threshold for sorting between a first and second classification of materials, and uses a second voltage threshold for sorting between second and third classifications of materials. In further examples, the control system uses shape and/or size information for the particle in conjunction with the classification input to determine a data vector associated with the particle, and classifies the particle as a function of the data vector.

In various embodiments, a method is provided for sorting scrap particles. The method may be used to sort scrap particles. At least some of the scrap particles comprise metal. In one example, the method sorts particles containing metal from non-metal particles into two or more classifications. In other examples, the method sorts particles containing different metals, or wire versus non-wire, into two or more classifications. A series of analog signals are received from a sensor array having a series of analog proximity sensors arranged such that active end faces of the sensors lie in a common sensing plane. The series of signals are processed to locate and identify a scrap particle containing metal on a conveyor passing over the array. Each signal may be quantized to provide a value having at least 4, 8, 16, or higher bit resolution. A linescan image or matrix is created that corresponds to a physical location of the conveyor by analyzing the analog signals from the sensor array, with each cell in the matrix corresponding to an associated analog sensor in the array. A value from each sensor is input into a cell of the matrix based on the physical location of the conveyor. Cells in the matrix that contain a particle are identified by distinguishing the particle from a background indicative of the conveyor, and a classification input for the particle is calculated based on the values for each cell in the matrix associated with the particle. The particle is classified into one of the at least two classifications of material using the classification input. The classification input for the particle may be compared to one or more thresholds that are selected based on the at least two classifications of materials to be sorted. In further examples, the particle is classified as a function of a data vector that has both the classification input as well as shape and/or size information for the particle as determined using the cells in the matrix identified as the particle. The particle is then sorted into one of the classifications.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A system comprising:

a conveyor for carrying at least two categories of scrap particles positioned at random on a surface of the conveyor, at least some of the particles comprising metal, the conveyor traveling in a first direction;

a sensor array having a series of analog inductive proximity sensors arranged transversely across the conveyor, wherein an active sensing end face of each sensor lies in a sensing plane, wherein the sensing plane is generally parallel with the surface of the conveyor; and a control system configured to sample and quantize analog signals from the series of sensors in the array, and locate and classify a scrap particle on the conveyor passing over the array into one of at least two categories of material based on the quantized signals;

wherein the control system is further configured to form a matrix corresponding to a physical location on the conveyor, input the quantized analog signal from a sensor in the array into a cell of the matrix, identify a grouping of cells in the matrix containing a particle by distinguishing the particle from a background indicative of the conveyor, calculate a classification input for the particle based on a value in at least one cell in the matrix associated with the grouping, and classify the particle into one of at least two categories of material based on the classification input.

2. The system of claim 1 wherein the series of sensors in the sensor array are arranged into at least first and second rows of sensors, wherein each row of sensors extends transversely across the conveyor; and wherein sensors in a first row in the array are offset transversely from sensors in a second row in the array.

3. The system of claim 1 wherein an area of the active sensing end face of each sensor is sized to be on the same order as a projected area of a scrap particle.

4. The system of claim 1 further comprising a separating unit positioned downline of the sensor array;

wherein the control system is further configured to control the separating unit to sort the particle on the conveyor based on the location and classification of the particle.

5. The system of claim 1 wherein each row of the matrix has a cell associated with each sensor in the array; and wherein the quantized analog signal is indicative of one of a voltage amplitude and a voltage rate of change.

6. The system of claim 1 wherein the control system is further configured to sample and quantize each analog signal such that the quantized analog signal is assigned at least an eight-bit value.

7. The system of claim 1 wherein the control system is further configured to classify the particle by comparing the classification input for the particle to one or more thresholds that are selected based on the at least two categories of materials.

8. The system of claim 7 wherein the control system is configured to use a first voltage threshold for sorting between a first and second categories of materials sensed by the array, and use a second voltage threshold for sorting between second and third categories of materials sensed by the array.

9. The system of claim 1 wherein the control system is further configured to use a secondary classification input as determined from the sensor array in conjunction with the classification input to determine a data vector associated with the particle, and classify the particle as a function of the data vector.

10. A method comprising:

sensing scrap particles on a surface of a moving conveyor using a sensing array with a series of analog proximity sensors arranged such that active end faces of each of the sensors lie in a common sensing plane, the common sensing plane being generally parallel with the surface of the conveyor;

sampling and quantizing an analog signal from each of the sensors in the array using a control system to provide a corresponding quantized value;

creating a matrix corresponding to a timed, physical location of the conveyor using the control system and inputting quantized values into cells in the matrix;

identifying a grouping of cells in the matrix as a particle using the control system by distinguishing the particle from a background indicative of the conveyor; and classifying the particle using the control system into one of at least two categories of material using a classification input calculated from the values in the grouping of cells in the matrix associated with the particle.

11. The method of claim 10 further comprising controlling a separating unit to sort the particle into one of the at least two categories of materials based on the classification.

12. The method of claim 10 wherein each cell in a row of the matrix corresponds to an associated sensor in the array; and wherein the quantized value is representative of one of a voltage amplitude and a voltage rate of change.

13. The method of claim 10 wherein the quantized value is input into a corresponding cell in the matrix by the control system if the quantized value falls within a predefined range of values.

14. The method of claim 10 wherein the particle is classified using the control system by comparing the classification input to one or more thresholds that are selected based on the at least two categories of materials to be sorted.

15. The method of claim 10 wherein the particle is classified using the control system by comparing the classification input to a first threshold for sorting between first and second categories of materials, and to a second threshold for sorting between second and third categories of materials.

16. The method of claim 15 wherein the control system creates the matrix using analog signals from only the sensor array.

17. The method of claim 10 further comprising determining a secondary classification input for the particle from the grouping of cells;

wherein the particle is classified using the control system into one of the at least two categories as a function of a data vector for the grouping, the data vector comprising the classification input and the secondary classification input.

18. The method of claim 17 wherein the control system classifies the particle by inputting the data vector into a machine learning algorithm.

19. The method of claim 17 wherein the secondary classification input is at least one of a voltage rate of change, a sum of the voltages over an area associated with the particle, a calculated shape of the particle, a size of the particle, a texture feature of the particle, and a voltage standard deviation.

20. The method of claim 10 further comprising calculating the classification input from the values in the grouping of cells in the matrix associated with the particle as a peak voltage from a cell associated with the grouping.

* * * * *